US007048048B2

(12) United States Patent
Nguyen et al.

(10) Patent No.: US 7,048,048 B2
(45) Date of Patent: May 23, 2006

(54) EXPANDABLE SAND CONTROL SCREEN AND METHOD FOR USE OF SAME

(75) Inventors: Philip D. Nguyen, Duncan, OK (US); Jimmie D. Weaver, Duncan, OK (US); Johnny A. Barton, Marlow, OK (US); R. Ashley Donaldson, Houston, TX (US); Alex Procyk, Houston, TX (US); Jackie M. LaFontaine, Spring, TX (US); Ralph H. Echols, Dallas, TX (US); Perry C. Shy, Southlake, TX (US); Timothy E. Harms, The Colony, TX (US); Gregory B. Chitwood, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 183 days.

(21) Appl. No.: 10/607,011

(22) Filed: Jun. 26, 2003

(65) Prior Publication Data

US 2004/0261994 A1 Dec. 30, 2004

(51) Int. Cl.
*E21B 43/08* (2006.01)

(52) U.S. Cl. ..... 166/227; 166/207

(58) Field of Classification Search ..... 166/227, 166/206, 207, 381, 382, 369
See application file for complete search history.

(56) References Cited

U.S. PATENT DOCUMENTS 2,981,332 A * 4/1961 Miller et al. ..... 166/276
2,981,333 A * 4/1961 Miller et al. ..... 166/276
3,099,318 A 7/1963 Miller et al.
6,431,282 B1 * 8/2002 Bosma et al. ..... 166/288
6,543,545 B1 * 4/2003 Chatterji et al. ..... 166/381
2003/0056948 A1 3/2003 Cameron
2003/0075323 A1 * 4/2003 Vercaemer et al. ..... 166/277
2004/0035590 A1 * 2/2004 Richard ..... 166/384
2004/0040703 A1 * 3/2004 Longmore ..... 166/207

FOREIGN PATENT DOCUMENTS

WO WO 00/39432 * 7/2000
WO WO 01/92681 12/2001
WO WO 02/23009 3/2002

OTHER PUBLICATIONS

"International Search Report": 15 pages.

* cited by examiner

*Primary Examiner*—Hoang Dang
(74) *Attorney, Agent, or Firm*—Lawrence R. Youst

(57) ABSTRACT

An expandable sand control screen (100) that is positionable within a wellbore comprises a fluid permeable generally tubular member (102) that is expanded downhole. A filtering assembly is disposed exteriorly of the generally tubular member (102). The filtering assembly includes a filter medium (106) that prevents the flow of particulate material of a predetermined size therethrough but allows the flow of production fluids therethrough. The filtering assembly also includes a compliable member (118) that has a thickness that is radially variable downhole. During or after expansion of the expandable sand control screen (100), the radial variability of the thickness of the compliable member (118) allows the expandable sand control screen (100) to comply with any irregularities in the wellbore profile, thereby preventing any void regions between the expandable sand control screen (100) and the wellbore.

32 Claims, 11 Drawing Sheets

28
26
10
12
20
18
30
22
24
16
34
32
38
36
40
14

EXPANDABLE SAND CONTROL SCREEN AND METHOD FOR USE OF SAME

TECHNICAL FIELD OF THE INVENTION

This invention relates in general to preventing the production of particulate materials into a wellbore traversing an unconsolidated or loosely consolidated subterranean formation and, in particular, to an expandable sand control screen and method for preventing voids between the expandable sand control screen and the wellbore.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

More recently, attempts have been made to foregoing the expense of cementing casing in the wellbore proximate the production interval and performing a gravel packing operation by utilizing expandable sand control screens. Typically, expandable sand control screens are designed to not only filter particulate materials out of the formation fluids, but also provide radial support to the formation to prevent the formation from collapsing into the wellbore. It has been found, however, that conventional expandable sand control screens are not capable of contacting the wall of the wellbore along their entire length as the wellbore profile is not uniform. More specifically, due to the process of drilling the wellbore and heterogeneity of the downhole strata, washouts or other irregularities commonly occur which result in certain locations within the wellbore having larger diameters than other areas or having non circular cross sections. Thus, when the expandable sand control screens are expanded, voids are created between the expandable sand control screens and the irregular areas of the wellbore. These voids then become filled with the particulate materials in the formation fluids which drastically reduces the production rate of formation fluids into the wellbore.

Therefore, a need has arisen for an expandable sand control screen that replaces the need for cementing casing in the wellbore proximate the production interval and performing a gravel packing operation. A need has also arisen for such an expandable sand control screen that is capable of not only filtering particulate materials out of the formation fluids, but also providing radial support to the formation to prevent the formation from collapsing into the wellbore. Further, a need has arisen for such an expandable sand control screen that does not leave voids between the expandable sand control screen and the wellbore after expansion.

SUMMARY OF THE INVENTION

The present invention disclosed herein comprises an expandable sand control screen that replaces the need for cementing casing in the wellbore proximate the production interval and performing a gravel packing operation. In addition, the expandable sand control screen of the present invention not only filters particulate materials out of the formation fluids, but also provides radial support to the formation to prevent the formation from collapsing into the wellbore. Further, the expandable sand control screen of the present invention does not leave voids between the expandable sand control screen and the wellbore after expansion.

The expandable sand control screen of the present invention comprises a generally tubular member that is expanded downhole. The generally tubular member has drainage openings that allow the flow of production fluids therethrough. A filtering assembly is disposed exteriorly of the generally tubular member. The filtering assembly prevents the flow of particulate material of a predetermined size therethrough but allows the flow of production fluids therethrough. In addition, the filtering assembly has a thickness that is radially variable downhole responsive to the wellbore profile such that void regions are prevented between the expandable sand control screen and the wellbore, thereby preventing the migration of formation fines into the wellbore.

In one embodiment, the filtering assembly is a multi component structure including a filter medium that prevents the flow of particulate material of a predetermined size therethrough but allows the flow of production fluids therethrough and a compliable member that has a thickness that is radially variable downhole responsive to the wellbore profile and that allows the flow of production fluids therethrough.

In one embodiment, the filter medium includes a plurality of layers of wire mesh that are bonded together to form a porous wire mesh screen. In another embodiment, the filter medium includes a layer of relatively fine wire mesh positioned between layers of relatively coarse wire mesh. In either embodiment, the filter medium may include a protective outer shroud.

In one embodiment, the compliable member is a compressible filler material disposed exteriorly of the filter medium that resiliently recovers downhole toward the wellbore in void regions. The compressible filler material may be an open cell foam constructed from resins, polyolefins, polyurethanes, polyvinylchlorides, metals and ceramics. The compressible filler material may alternatively be a fiberglass wool or a steel wool such as stainless steel wool.

In embodiments having a compressible filler material, the expandable sand control screen may include a removable outer wrapper that is disposed exteriorly of the compressible filler material to temporarily maintain the compressible filler material in a compressed position. The removable outer wrapper may be shrinkable to help place and maintain the compressible filler material in the compressed position. The removable outer wrapper may be removed from the compressible filler material during or following the downhole expansion of the expandable sand control screen mechanically, chemically, thermally, dissolvably, biodegradably or by other suitable means. In addition, the removable outer wrapper may be a film, a foil, a sleeve, a strap or the like and may be constructed from polymers, metals, ceramics or the like.

Treatment chemicals may be impregnated into the compressible filler material. The treatment chemicals may take the form of powders, tablets, beads or the like. The treatment chemicals may, for example, include mud breakers, oxidizers, enzymes, hydrolyzable esters, acids, scale inhibitors, biocides, corrosion inhibitors, paraffin inhibitors and the like. Alternative or additionally, solid materials such as sand, gravel, proppants or beads may be impregnated into the compressible filler material to assure permeability. In another embodiment, the compressible filler material may include one or more permeable sections positioned between one or more impermeable section.

In another embodiment, the compliable member is a crushable layer having a thickness that is radially reducible in response to contact between at least a portion of the expandable sand control screen and the wellbore when the expandable sand control screen is expanded downhole. The crushable layer may either be disposed between the filter medium and the generally tubular member or the crushable layer may be disposed exteriorly of the filter medium.

In one embodiment, the crushable layer may be a single layer or a multi layer honeycomb structure. In another embodiment, the crushable layer may include a plurality of crushable elements. In a further embodiment, the crushable layer may include a mesh structure. In yet another embodiment, the crushable layer may include a corrugated structure. In any of the embodiments, the crushable layer may be constructed from a metal such as a stainless steel.

In another embodiment, the filtering assembly is a single component structure comprising a crushable filter medium disposed exteriorly of the tubular member. The crushable filter medium has a thickness that is radially reducible in response to contact between at least a portion of the expandable sand control screen and the wellbore when the expandable sand control screen is expanded downhole. In addition, the crushable filter medium prevents the flow of particulate material of a predetermined size therethrough but allows the flow of production fluids therethrough.

The crushable filter medium may be constructed from plurality of layers of wire mesh that are bonded together to form a fluid porous wire mesh crushable filter medium including, for example, a layer of relatively fine wire mesh positioned between layers of relatively coarse wire mesh. The crushable filter medium may be take the form of a honeycomb structure, a multi layer honeycomb structure, a mesh structure, a corrugated structure or the like.

In another aspect, the present invention comprises a method of completing a wellbore that includes the steps of providing an expandable sand control screen having a filtering assembly disposed exteriorly of the generally tubular member, running the expandable sand control screen into the wellbore, expanding the expandable sand control screen downhole and radially varying the thickness of the filtering assembly downhole responsive to the wellbore profile.

In a further aspect, the present invention comprises a method for delivery of a treatment chemical into a downhole environment that includes the steps of impregnating the treatment chemical within a carrier material, running the carrier material downhole on a tubing string and releasing the treatment chemical into the downhole environment from the carrier material.

In still another aspect, the present invention comprises a method of production profile management that includes the steps of disposing a compressible filler material exteriorly of an expandable sand control screen in a compressed position, the compressible filler material having at least one permeable section and at least one impermeable, running the expandable sand control screen into the wellbore, expanding the expandable sand control screen downhole, releasing the compressible filler material from the compressed position such that the compressible filler material contacts the wellbore and isolating sections of the wellbore from one another with the at least one impermeable section of the filler material.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
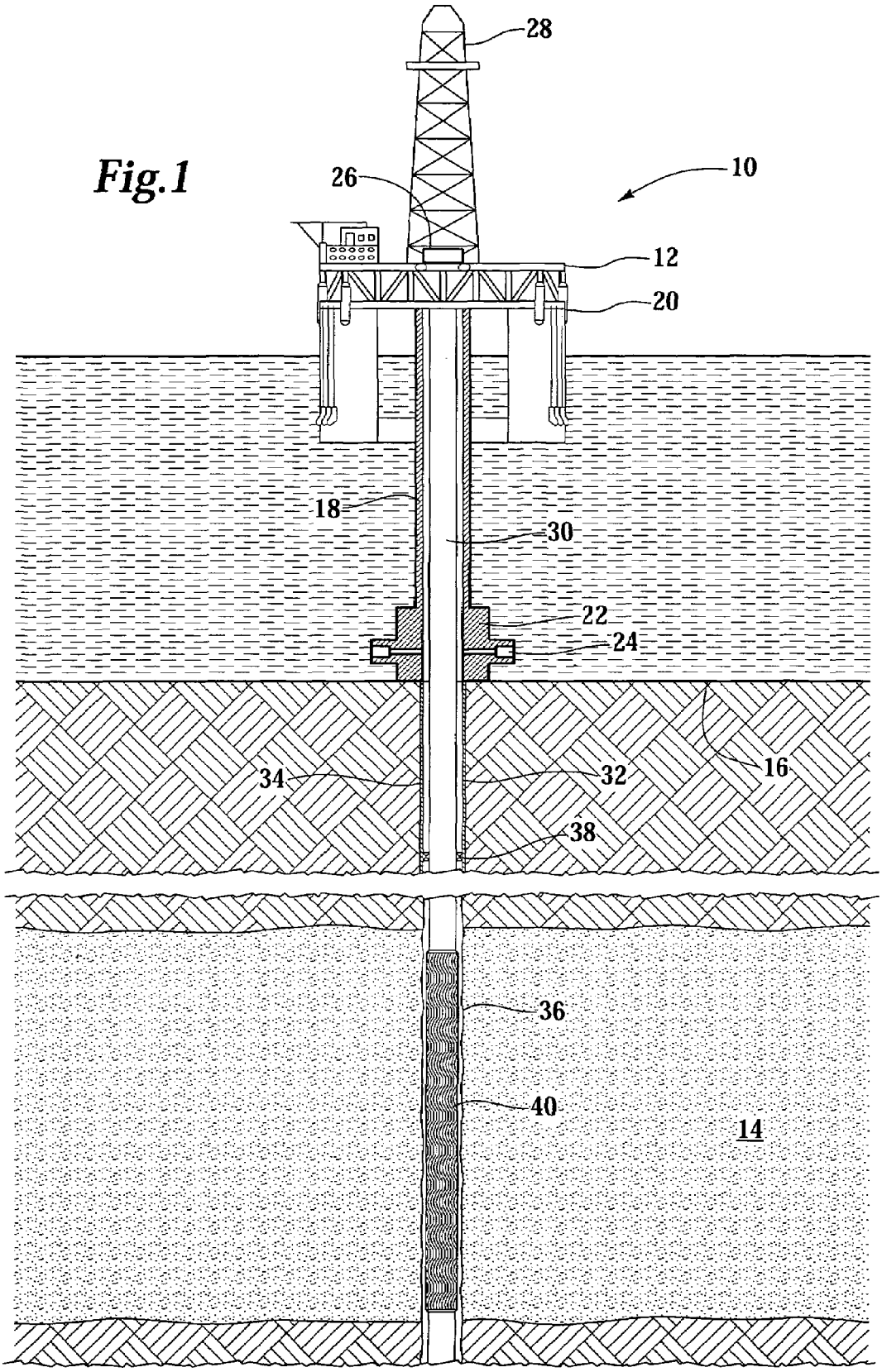
FIG. 1 is a schematic illustration of an offshore oil and gas platform operating an expandable sand control screen of the present invention.

Referring initially to FIG. 1, an offshore oil and gas platform installing completion equipment that includes an expandable sand control screen of the present invention is schematically illustrated and generally designated 10. A semi-submersible platform 12 is centered over submerged oil and gas formations 14 located below sea floor 16. A subsea conduit 18 extends from deck 20 of platform 12 to wellhead installation 22 including subsea blowout preventers 24. Platform 12 has a hoisting apparatus 26 and a derrick 28 for raising and lowering pipe strings such as work string 30.

A wellbore 32 extends through the various earth strata including formation 14. A casing 34 extends partially into wellbore 32 and is cemented therein. Wellbore 32 also has an open hole portion 36 that intersects formation 14. Work string 30 includes various tools such as packer 38 that provides fluid control in wellbore 32 and expandable sand control screen 40 that is positioned adjacent to formation 14 for filtering the fluids produced therefrom. Once expandable sand control screen 40 is position as depicted in FIG. 1, expandable sand control screen 40 is expanded and operated such that expandable sand control screen 40 contacts open hole portion 36 of wellbore 32 without leaving voids between expandable sand control screen 40 and wellbore 32, thereby not only filtering particulate materials out of the formation fluids, but also, providing radial support to formation 14 to prevent the collapse of formation 14 and preventing formation fine migration into wellbore 14 as will be explained in greater detail hereinbelow.

Even though FIG. 1 depicts a vertical well, it should be noted by one skilled in the art that the expandable sand control screen of the present invention is equally well-suited for use in deviated wells, inclined wells or horizontal wells. Accordingly, in the following description use of, directional terms, such as "above", "below", "upper", "lower", etc., is only for convenience in referring to the accompanying drawings. Also, even though FIG. 1 depicts an offshore operation, it should be noted by one skilled in the art that the expandable sand control screen of the present invention is equally well-suited for use in onshore operations.

Figure 2:
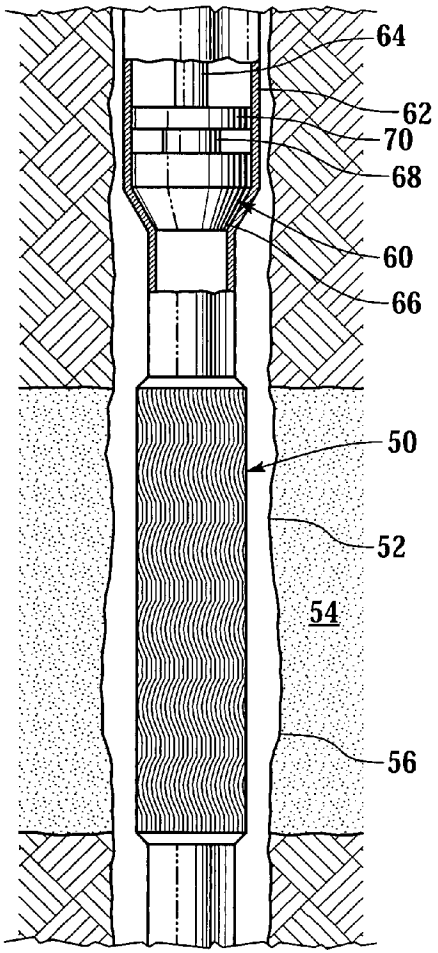
FIG. 2 is half section view of an expandable sand control screen of the present invention positioned within a wellbore during a first step of a completion process.

Referring now to FIG. 2, therein is depicted an expandable sand control screen of the present invention that is generally designated 50. As depicted, expandable sand control screen 50 has been conveyed into an open hole wellbore 52 that intersects formation 54 from which it is desired to produce fluids. As is typically, due to the drilling process as well as the heterogeneity of downhole strata, wellbore 52 has a nonuniform hole size. In addition, wellbore 52 includes a washout region 56 which may have a significant size deviation relative to the remainder of wellbore 52.

In order to foregoing the expense of cementing casing in wellbore 52 to prevent the collapse of wellbore 52 and performing a gravel packing operation to control the production of particulate materials from formation 54, expandable sand control screen 50 is expanded toward wellbore 52. In the illustrated embodiment, an expander member 60 is positioned in tubular member 62 by a retrievable conduit 64 and is operable to deform and radially expand tubular member 62 and expandable sand control screen 50.

Expander member 60 includes a tapered cone section 66, a piston 68 and an anchor section 70. In operation, a downward force is applied on expander member 60 by applying the weight of retrievable conduit 64 on expander member 60. This downward force operates to stroke piston 68 to its compressed position. Once piston 68 completes its downward stroke, fluid is pumped into expander member 60 which sets anchor section 70 creating a gripping force against the interior of tubular member 62. As more fluid is pumped down retrievable conduit 64 into the interior of expander member 60, the fluid pressure urges tapered cone section 66 downwardly such that tapered cone section 66 places a radially outward force against the wall of tubular member 62 causing tubular member 62 to radially outwardly deform into a larger diameter. This process continues in step wise fashion wherein each stroke of expander member 60 expands a section of tubular member 62. In addition, expander member 60 radially enlarges expandable sand control screen 50 when expander member 60 passes therethrough. After tubular member 62 and expandable sand control screen 50 have been expanded, retrievable conduit 64 and expander member 60 may be retrieved to the surface. It should be appreciated that although a specific type of expander member, i.e., a hydraulically powered expander member has been presented, the method of expanding expandable sand control screen 50 of the present invention may employ any suitable technique.

Figure 3:
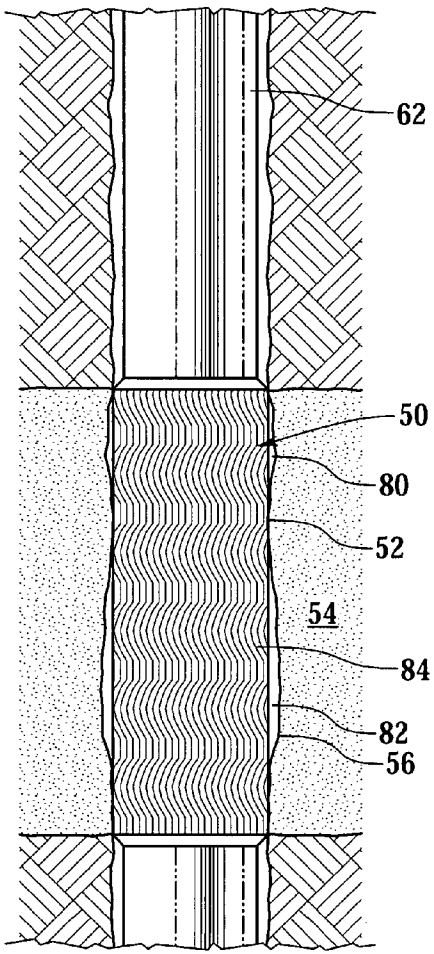
FIG. 3 is half section view of an expandable sand control screen of the present invention positioned within a wellbore during a second step of a completion process.

As best seen in FIG. 3, once expandable sand control screen 50 has been radially expanded toward wellbore 52, expandable sand control screen 50 does not make intimate contact with wellbore 52 along the entire length of expandable sand control screen 50 due to the irregularities in the wellbore profile. Specifically, void regions are formed between expandable sand control screen 50 and wellbore 52. For example, a void region 80 exists near the top of expandable sand control screen 50 and a void region 82 exists between expandable sand control screen 50 and washout region 56. Even with void regions 80, 82, expandable sand control screen 50 provides suitable support to formation 54 to prevent formation 54 from collapsing into wellbore 52. Void regions 80, 82, however, create locations into which particulate material from formation 54 will migrate, resulting in a significant reduction in the production rate from formation 54.

Figure 4:
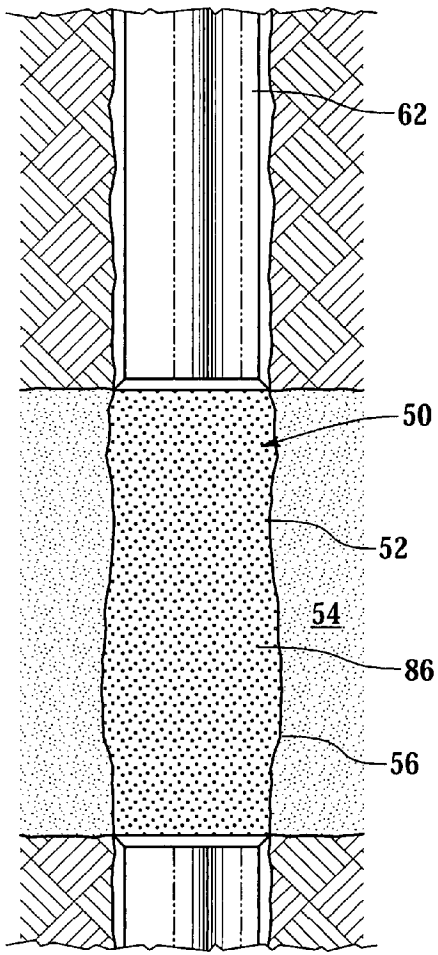
FIG. 4 is half section view of an expandable sand control screen of the present invention positioned within a wellbore during a third step of a completion process.

One of the advantages of expandable sand control screen 50 of the present invention is the prevention of such migration of particulate material from formation 54 into wellbore 52 by eliminating the voids between expandable sand control screen 50 and wellbore 52 including void regions 80, 82. Specifically, in the illustrated embodiment, an outer wrapper 84 that surrounds expandable sand control screen 50 is removed, as will be explained in greater detail below, such that a compliable member 86 is allowed to fill the voids between expandable sand control screen 50 and wellbore 52 including washout region 56, as best seen in FIG. 4 and as explained in greater detail below. Once expandable sand control screen 50 is in the configuration depicted in FIG. 4, migration of particulate material from formation 54 into wellbore 52 is prevented.

Even though wellbore 52 is depicted in FIGS. 2-4 as being uncased, it is to be clearly understood that the principles of the present invention may also be practiced in cased wellbores. Additionally, even though a single expandable sand control screen 50 is depicted, it is to be understood by those skilled in the art that any number of expandable sand control screens may be positioned within a completion system or adjacent to a producing formation, without departing from the principles of the present invention.

Figure 5:
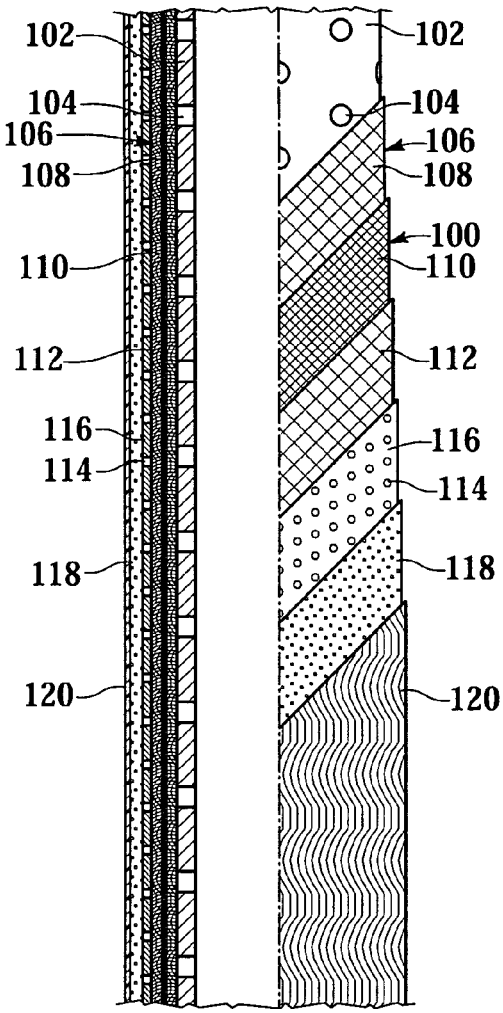
FIG. 5 is a quarter section view that is partially cut away of an expandable sand control screen of the present invention prior to removing the outer wrapper.

Referring additionally now to FIG. 5, an expandable sand control screen 100 embodying principles of the present invention is representatively illustrated. Expandable sand control screen 100 includes a generally tubular base pipe 102 that includes a plurality of drainage openings 104 which allow the flow of production fluids into the production tubing. The exact number, size and shape of openings 104 are not critical to the present invention, so long as sufficient area is provided for fluid production and the integrity of base pipe 102 is maintained.

Positioned around base pipe 102 is a filter medium 106. In the illustrated embodiment, filter medium 106 is a fluid-porous, particulate restricting, metal material such as a plurality of layers of a wire mesh that are diffusion bonded or sintered together to form a porous wire mesh screen designed to allow fluid flow therethrough but prevent the flow of particulate materials of a predetermined size from passing therethrough. More specifically, filter medium 106 includes three layers of filtering material, namely, an inner relatively coarse layer 108, a middle relatively fine layer 110 and an outer relatively coarse layer 112. The terms "fine" and "coarse" are used herein to indicate the relative size of particles permitted to pass through filter layers 108, 110, 112. That is, middle layer 110 filters fine or small-sized particles from fluid passing therethrough, while inner and outer layers 108, 112 filter coarse or larger-sized particles from fluid passing therethrough.

It should be noted that, inner and outer layers 108, 112 are not necessarily used for their filtering properties, although at least outer layer 112 will filter larger-sized particles from fluid flowing into expandable sand control screen 100. Instead, inner and outer layers 108, 112 are used primarily to provide for flow between openings 104 of base pipe 102 and opening 114 in outer shroud 116 after expandable sand control screen 100 is expanded. For example, if filter layers 108, 112 are made of a relatively coarse woven material, fluid may flow transversely through layers 108, 112 between shroud 116 and base pipe 102. Thus, fluid may flow into one of the openings 114, flow transversely through outer filter layer 112, flow inwardly through middle filter layer 100, flow transversely through inner filter layer 108 to one of the openings 104, and then flow inwardly through opening 104.

In the illustrated embodiment, expandable sand control screen 100 has a generally tubular protective outer shroud 116 outwardly overlying filter medium 106. Outer shroud 116 has openings 114 formed through a sidewall thereof to admit fluid into expandable sand control screen 100. Expandable sand control screen 100 has a generally tubular, compressible filler material 118 outwardly overlying outer shroud 116. Expandable sand control screen 100 also has a generally tubular removable outer wrapper 120 outwardly overlying filler material 118. Together, compressible filler material 118 and filter medium 106 form the filtering assembly of expandable sand control screen 100.

Filler material 118 may be in the form of a single layer or multi-layer sleeve, jacket or wrap that is tightly fitted, glued or otherwise attached to outer shroud 116. Filler material 118 is a compliable member that enables expandable sand control screen 100 of the present invention to fill any voids that exist between expandable sand control screen 100 and the wellbore after expandable sand control screen 100 has been expanded as the thickness of filler material 118 is radially variable downhole responsive to the wellbore profile. Filler material 118 preferably has a thickness of between about 0.25 inches and 2 inches. It should be apparent to those skilled in the art, however, that the thickness of filler material 118 will be dependent upon factors such the clearance within the wellbore, the composition of filler material 118, the compressibility and resilient recovery properties of filler material 118 and the like. Depending upon the composition of filler material 118, filler material 118 may be formed by molding, casting or other suitable techniques.

Figure 6:
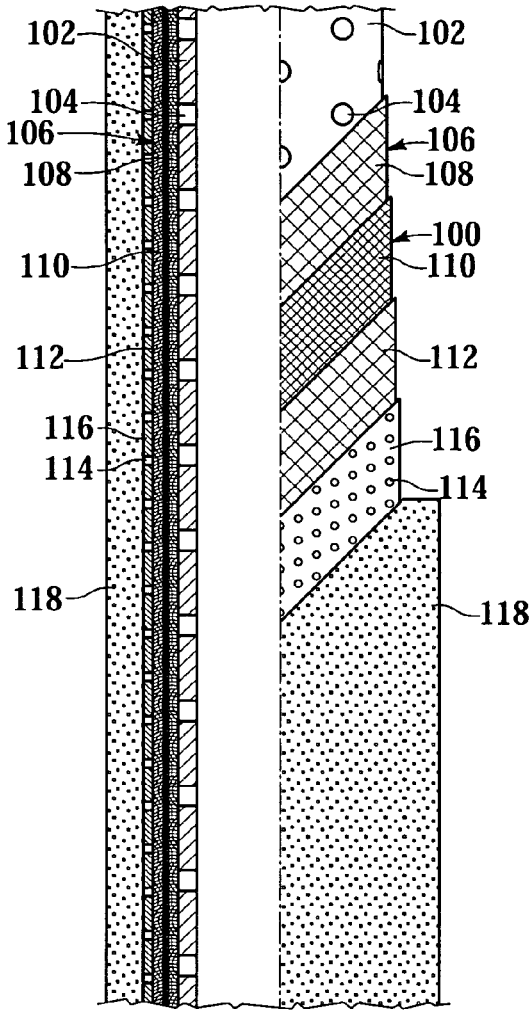
FIG. 6 is a quarter section view that is partially cut away of the expandable sand control screen of FIG. 5 after removing the outer wrapper.

Filler material 118 is preferably constructed from a fluid permeable, compressible material such as an open cell foam. For example, the open cell foam may be formed from resins, polyolefins, polyurethanes, polyvinylchlorides, metals, ceramics or the like and combination thereof. Alternative, filler material 118 may be constructed from any other type of fluid permeable material that can be radially compressed to allow expandable sand control screen 100 to run through any restrictions in the wellbore and that will resiliently recover from the radially compressed configuration after expandable sand control screen 100 has been expanded and outer wrapper 120 has been removed, as best seen in FIG. 6. For example, filler material 118 may alternatively be constructed from stainless steel wool, fiberglass wood or the like. It is to be understood by those skilled in the art that in those embodiments wherein filler material 118 also has filtration properties, the filler material may be placed directly around an expandable perforated tubular without the need for the separate filter medium in which case filler material 118 forms the entire filter assembly of expandable sand control screen 100.

Removable outer wrapper 120 temporarily maintains filler material 118 in the radially compressed configuration for running expandable sand control screen 100 downhole. Removable outer wrapper 120 is preferably a relatively thin film, foil, sleeve, sheath, mesh network or the like constructed from polymers, metals, ceramics or the like. When removable outer wrapper 120 is a polymer, removable outer wrapper 120 may preferably be a biodegradable polymer or biodegradable polymer resin that degrades with time and exposure to temperatures above 120–140 degrees Fahrenheit. For example, suitable biodegradable polymers include, but are not limited to, lactide polymers, polylactide polymers, aliphatic polyesters and copolymers, blends and mixtures thereof. In particular, outer wrapper 120 may be constructed from fibers or filaments containing polylactide polymer in woven or nonwoven fabrics, the fibers being either monocomponent fibers or multicomponent fibers.

It should be noted by those skilled in the art that the polylactide polymer composition can include other components blended in with the polymer. Preferably, the composition will include at least about 20% by weight polylactide. More preferably, the composition will include at least about 70% by weight polylactide. Most preferably, the composition will include at least about 90% by weight polylactide. It should be appreciated, however, that the amount of polylactide present in a particular composition will depend upon the desired properties to be imparted to removable outer wrapper 120.

Preferably, removable outer wrapper 120 is positioned around filler material 118 once filler material 118 have been pressure-packed, vacuum-packed or otherwise compressed into the running position. Alternatively, removable outer wrapper 120 may be a shrink-wrap or heat-wrap used to compress filler material 118 once removable outer wrapper 120 is placed around filler material 118 by, for example, applying heat to removable outer wrapper 120. Once filler material 118 is held in the radially compressed configuration by removable outer wrapper 120 and expandable sand control screen 100 has been run downhole and expanded, removable outer wrapper 120 is removed such that filler material 118 is allowed to resiliently recover toward its non-compressed state to fill any voids surrounding expandable sand control screen 100. The method used to remove removable outer wrapper 120 from expandable sand control screen 100 will be determined based upon the material of removable outer wrapper 120. For example, if removable outer wrapper 120 is a biodegradable polymer, time and heat will remove removable outer wrapper 120. Alternatively, removable outer wrapper 120 may be removed using a chemical attack to dissolve removable outer wrapper 120 or by mechanical means either during or following expansion of expandable sand control screen 100.

Figure 7:
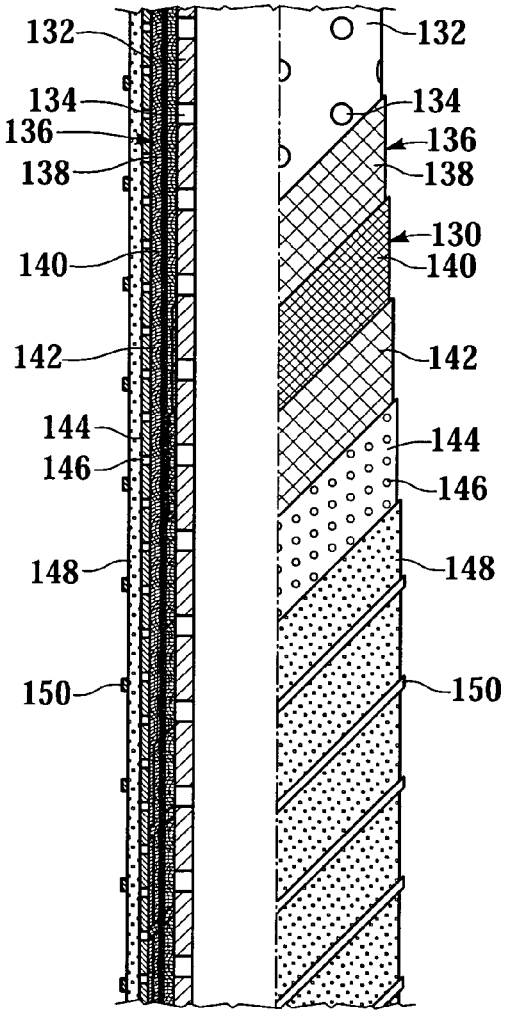
FIG. 7 is a quarter section view that is partially cut away of another embodiment of an expandable sand control screen of the present invention prior to removing the outer wrapper.
Figure 8:
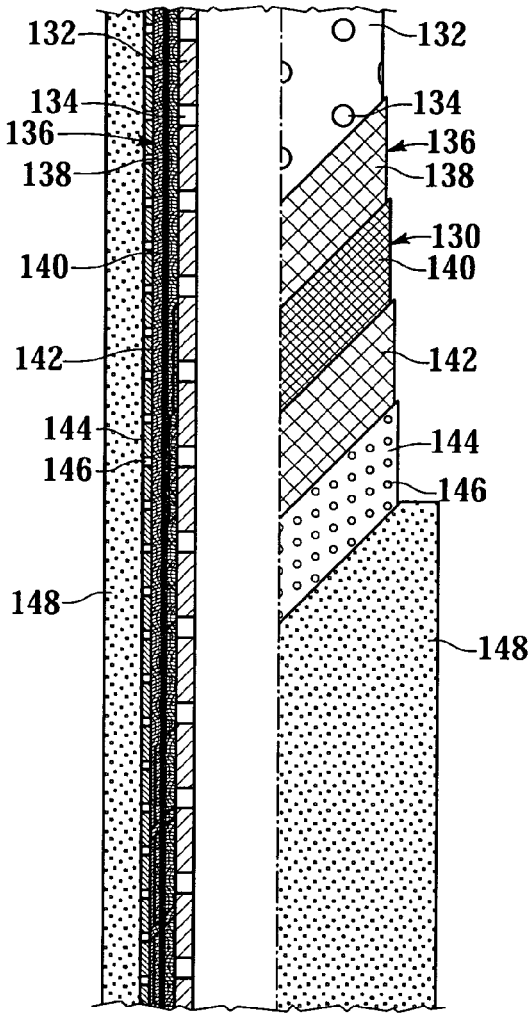
FIG. 8 is a quarter section view that is partially cut away of the embodiment of an expandable sand control screen of FIG. 7 after removing the outer wrapper.

Referring now to FIGS. 7 and 8, an expandable sand control screen 130 embodying principles of the present invention is representatively illustrated. Expandable sand control screen 130 includes a generally tubular base pipe 132 that includes a plurality of drainage openings 134 which allow the flow of production fluids into the production tubing. Positioned around base pipe 132 is a filter medium 136. In the illustrated embodiment, filter medium 136 includes three layers of filtering material, namely, an inner relatively coarse layer 138, a middle relatively fine layer 140, and an outer relatively coarse layer 142. A generally tubular protective outer shroud 144 outwardly overlies filter medium 136. Outer shroud 144 has openings 146 formed through a sidewall thereof to admit fluid into expandable sand control screen 130. A compliable member illustrated as filler material 148 outwardly overlies outer shroud 144. Together, filter medium 136 and filler material 148 form the filtering assembly for expandable and control screen 130.

Expandable sand control screen 130 has a removable outer wrapper 150 outwardly overlying filler material 148. In the illustrated embodiment, outer wrapper 150 is in the form of one or more straps or bands made from a polymer or metal that are preferably circumferentially or helically wound around filler material 148 to maintain filler material 148 in the radially compressed configuration depicted in FIG. 7. As the thickness of filler material 148 is radially variable responsive to the wellbore profile, once positioned downhole, removable outer wrapper 150 is removed by any suitable technique allowing filler material 148 to resiliently recover toward its non-compressed state to fill any voids surrounding expandable sand control screen 130.

Figure 9:
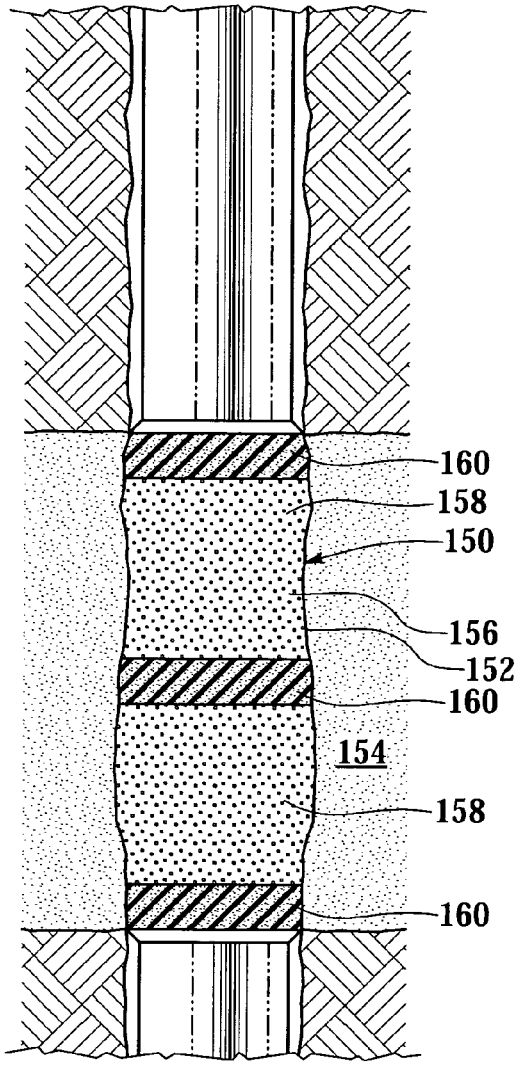
FIG. 9 is half section view of an alternate embodiment of an expandable sand control screen of the present invention positioned within a wellbore.

Referring next to FIG. 9, therein is depicted an expandable sand control screen of the present invention that is generally designated 151. As depicted, expandable sand control screen 151 has been conveyed into an open hole wellbore 152 that intersects formation 154 from which it is desired to produce fluids. In addition, expandable sand control screen 151 has been expanded downhole and the outer wrapper has been removed from around filler material 156 such that filler material 156 has resiliently recovered from its radially compressed running configuration to fill any voids left between expandable sand control screen 151 and wellbore 152 following the expansion of expandable sand control screen 151.

Unlike the previously described embodiments of the filler material, filler material 156 includes both permeable sections 158 and impermeable sections 160. Permeable sections 158 are constructed in the manner described above from open cell foams, steel wool, fiberglass wool and the like to allow the flow of production fluids therethrough but prevent the migration of formation fines into wellbore 152. Impermeable sections 160 are designed to prevent both the radial and axial flow of fluids and the migration of formation fines into wellbore 152. Impermeable sections 160 are constructed from closed cell foams, gels, resins, elastomers, rubbers or the like and combinations thereof.

Use of filler material 156 allows for production profile management of one or more production intervals in a wellbore by sealing off certain sections of the wellbore from other sections of the wellbore. For example, filler material 156 may be used in place of packers to seal off one producing zone from another. Alternatively, in certain horizontal completions, it may be desirable to break up a long producing interval into a plurality of shorter intervals. For example, filler material 156 could have permeable sections 158 that are fifty to two hundred feet long separated by impermeable sections 160 that are ten to twenty feet long. This type of production profile management can increase the production rate for the entire interval by minimizing the likelihood of hot spots developing within the production interval.

Figure 10:
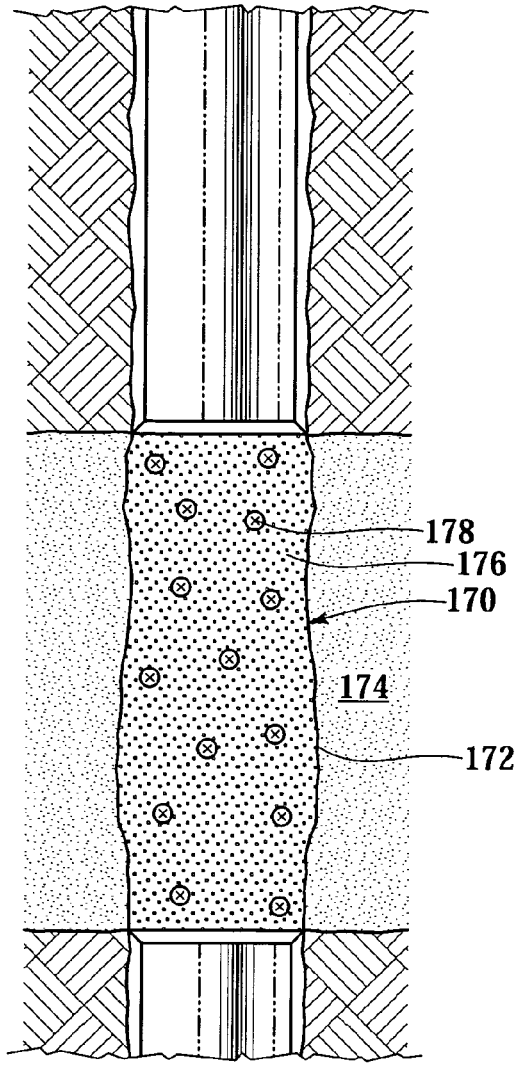
FIG. 10 is half section view of another alternate embodiment of an expandable sand control screen of the present invention positioned within a wellbore.

Referring next to FIG. 10, therein is depicted an expandable sand control screen of the present invention that is generally designated 170. As depicted, expandable sand control screen 170 has been conveyed into an open hole wellbore 172 that intersects formation 174 from which it is desired to produce fluids. In addition, expandable sand control screen 170 has been expanded downhole and the outer wrapper has been removed from around filler material 176 such that filler material 176 has resiliently recovered from its radially compressed running configuration to fill any voids left between expandable sand control screen 170 and wellbore 172 following the expansion of expandable sand control screen 170.

Unlike the previously described filler material, filler material 176 includes treatment chemicals 178 impregnated therein. As it is commonly desirable to chemically treat a producing interval of a wellbore to, for example, remove filter cake from the surface of the wellbore, filler material 176 may be used as the carrier material in a chemical delivery system. Specifically, treatment chemicals 178 in the form of powders, tablets, beads or the like are carried downhole within filler material 176. Depending upon the type and number of treatments to be performed, treatment chemicals 178 can be release into wellbore 172 quickly or over several hours or even days. Likewise, a treatment regiment may include multiple types of treatment chemicals 178 that may be release simultaneously or sequentially as desired. By way of example, treatment chemicals 178 may include mud breakers, oxidizers, enzymes, hydrolyzable esters, acids, scale inhibitors, biocides, corrosion inhibitors, paraffin inhibitors or the like and combination thereof.

Alternatively, items 178 of FIG. 10 may represent solid objects that are impregnated into filler material 176. For example, solid objects such as sand, gravel, proppants, beads or like may be placed within filler material 176 to assure that filler material 176 retains its permeable after being radially compressed for run in and following its resilient recovery downhole after removal of the outer wrapper. In this embodiment, it may be desirable to have a high density of the solid objects impregnated into filler material 176.

Figure 11:
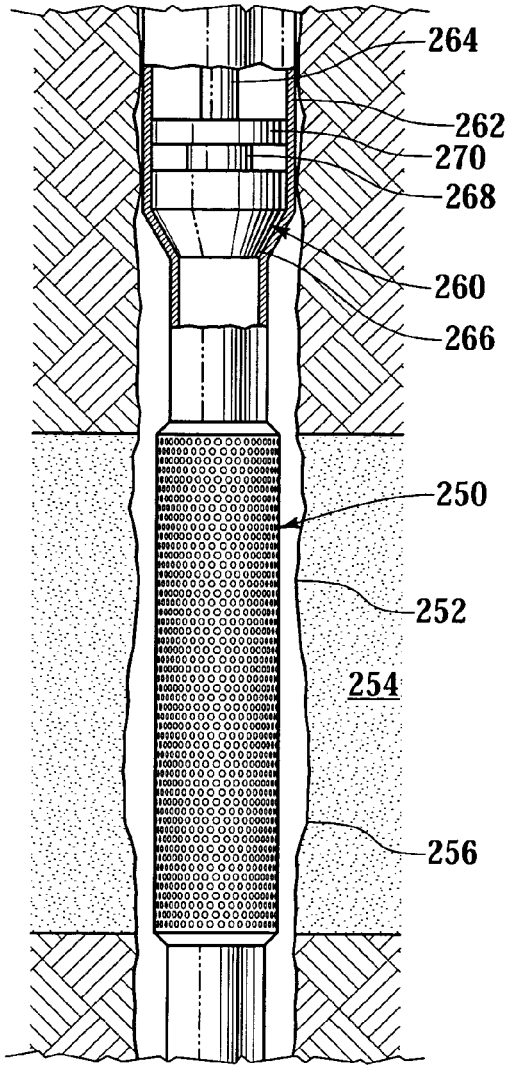
FIG. 11 is half section view of an expandable sand control screen of the present invention positioned within a wellbore during a first step of a completion process.

Referring now to FIG. 11, therein is depicted an expandable sand control screen of the present invention that is generally designated 250. As depicted, expandable sand control screen 250 has been conveyed into an open hole wellbore 252 that intersects formation 254 from which it is desired to produce fluids. As is typically, due to the drilling process as well as the heterogeneity of downhole strata, wellbore 252 has a nonuniform wellbore profile. In addition, wellbore 252 includes a washout region 256 which may have a significant size deviation relative to the remainder of wellbore 252.

In order to foregoing the expense of gravel packing wellbore 252 to control the production of particulate materials from formation 254 and to prevent the collapse of wellbore 252, expandable sand control screen 250 will be expanded into contact with wellbore 252. In the illustrated embodiment, an expander member 260 is positioned in tubular member 262 by a retrievable conduit 264 and is operable to deform and radially expand tubular member 262 and expandable sand control screen 250. Expander member 260 includes a tapered cone section 266, a piston 268 and an anchor section 270 and is operated in a manner similar to expander member 60 described above.

Figure 12:
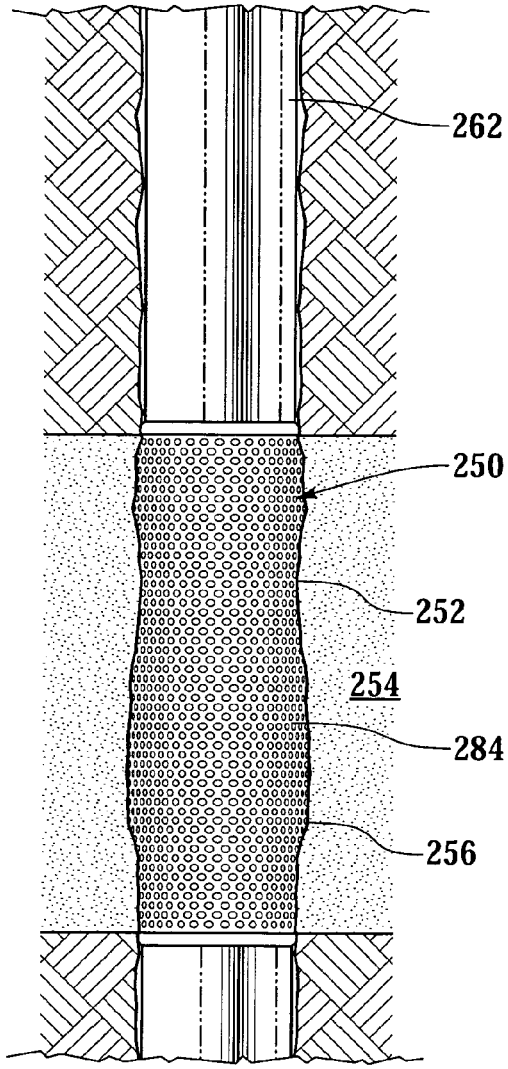
FIG. 12 is half section view of an expandable sand control screen of the present invention positioned within a wellbore during a second step of a completion process.

As best seen in FIG. 12, once expandable sand control screen 250 has been radially expanded within wellbore 252, expandable sand control screen 250 makes intimate contact with wellbore 252 along the entire length of expandable sand control screen 250 even though wellbore 252 has a nonuniform wellbore profile including washout region 256. Specifically, no void regions are formed between expandable sand control screen 250 and wellbore 252. Accordingly, expandable sand control screen 250 provides suitable support to formation 254 to prevent formation 254 from collapsing into wellbore 252. In addition, expandable sand control screen 250 of the present invention prevents migration of particulate material from formation 254 into wellbore 252. To achieve this result, expandable sand control screen 250 includes a compliable member, as will be explained in greater detail below, such that expandable sand control screen 250 conforms to the contours of wellbore 252, as best seen in FIG. 12.

Even though wellbore 252 is depicted in FIGS. 11 and 12 as being uncased, it is to be clearly understood that the principles of the present invention may also be practiced in cased wellbores. Additionally, even though a single expandable sand control screen 250 is depicted, it is to be understood by those skilled in the art that any number of expandable sand control screens may be positioned within a completion system or adjacent to a producing formation, without departing from the principles of the present invention.

Figure 13:
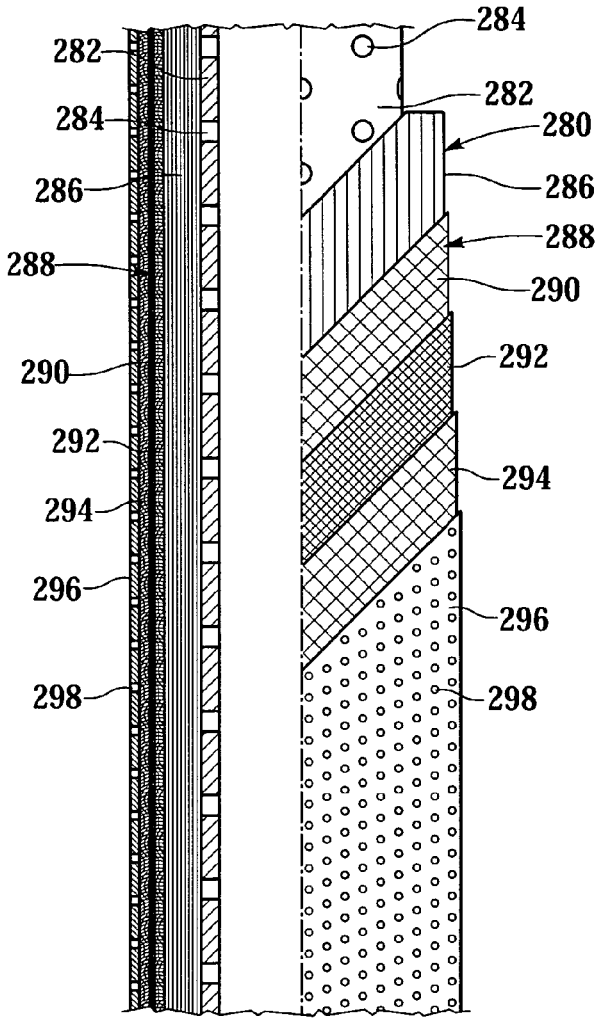
FIG. 13 is a quarter section view that is partially cut away of an expandable sand control screen having a crushable layer of the present invention.

Referring additionally now to FIG. 13, an expandable sand control screen embodying principles of the present invention is representatively illustrated and generally designated 280. Expandable sand control screen 280 includes a generally tubular base pipe 282 that includes a plurality of drainage openings 284 which allow the flow of production fluids into the production tubing. The exact number, size and shape of openings 284 are not critical to the present invention, so long as sufficient area is provided for fluid production, the integrity of base pipe 282 is maintained and base pipe 282 is suitably expandable.

Positioned around base pipe 282 is a compliable member depicted as crushable layer 286. Crushable layer 286 is fluid-porous such that production fluid may flow therethrough. Preferably, the porosity of crushable layer 286, even in its crushed configuration, is greater than the porosity of the surrounding filter medium such that crushable layer 286 will not significantly increase the pressure drop in the fluids produced therethrough. Crushable layer 286 preferably has a thickness of between about 0.25 inches and 2 inches and is preferably crushable to 80% of its original thickness, more preferably crushable to 50% of its original thickness and most preferably crushable to 20% of its original thickness. It should be apparent to those skilled in the art, however, that the thickness and crushability of crushable layer 286 will be dependent upon a variety of factors such as the clearance within the wellbore, the size of expandable sand control screen 280, the structural composition of crushable layer 286, the desired amount of expansion of expandable sand control screen 280, the expected deviation in the wellbore diameter and the like.

Positioned around crushable layer 286 is a filter medium 288. Together, crushable layer 286 and filter medium 288 form the filtering assembly of expandable sand control screen 280. In the illustrated embodiment, filter medium 288 is a fluid-porous, particulate restricting, metal material such as a plurality of layers of a wire mesh that are diffusion bonded or sintered together to form a porous wire mesh screen designed to allow fluid flow therethrough but prevent the flow of particulate materials of a predetermined size from passing therethrough. More specifically, the illustrated filter medium 288 includes three layers of filtering material, namely, an inner relatively coarse layer 290, a middle relatively fine layer 292 and an outer relatively coarse layer 294. As stated above, the terms "fine" and "coarse" are used herein to indicate the relative size of particles permitted to pass through filter layers 290, 292, 294. That is, middle layer 292 filters fine or small-sized particles from fluid passing therethrough, while inner and outer layers 290, 294 filter coarse or larger-sized particles from fluid passing therethrough.

It should be noted that, inner and outer layers 290, 294 are not necessarily used for their filtering properties, although at least outer layer 294 will filter larger-sized particles from fluid flowing into expandable sand control screen 280. Instead, inner and outer layers 290, 294 are used primarily as drain layers that provide for transverse flow within filter medium 288 which assures that production fluids will be able to radially pass through filter medium 288. In addition, it should be appreciated that in embodiments having filter medium 288 positioned around crushable layer 286, inner layer 290 of filter medium 288 may not be required as crushable layer 286 may also serve as the inner drain layer.

In the illustrated embodiment, positioned around outer layer 294 is a generally tubular protective outer shroud 296 which forms the outermost layer of filter medium 288 as well as the outer layer of expandable sand control screen 280. Outer shroud 296 has openings 298 formed through a sidewall thereof to admit fluid into expandable sand control screen 280. Outer shroud 296 protects filter layers 290, 292, 294 from damage while expandable sand control screen 280 is being conveyed and positioned in a well. Additionally, when expandable sand control screen 280 is expanded into radial contact with the wellbore, outer shroud 296 protects filter layers 290, 292, 294 from damage due to such contact and provides radial support to prevent collapse of the wellbore. Thus, outer shroud 296 is preferably constructed of a durable, deformable, high strength material, such as steel, which allows outer shroud 296 to comply with the irregular wellbore profile, although other materials may be used in keeping with the principles of the present invention. It should be noted that, in some embodiments wherein outer layer 294 is sufficiently rugged, outer shroud 296 may not be required, thereby positioning outer layer 294 directly against the wellbore upon expansion.

In operation, when expandable sand control screen 280 is expanded, crushable layer 286 has the strength to provide the desired level of support to filter medium 288 such that filter medium 288 can be radially expanded. In addition, crushable layer 286 has the desired level of compliability such that when one or more portions of filter medium 288 contact the wellbore, the thickness of the corresponding portions of crushable layer 286 are radially reducible such that expandable sand control screen 280 will comply with the irregular surface of the wellbore profile. Thus, crushable layer 286 is preferably constructed of a durable, elastically or plastically deformable, high strength material, such as a metal including steels and stainless steels, although other materials, including nonmetallic materials, may be used in keeping with the principles of the present invention.

In some embodiments, it may be desirable to include one or more expansion joints (not pictured) within filter medium 288 that reduce the force required to radially expand filter medium 288. For example, filter medium 288 could be formed with one or more circumferentially overlapping filter layers that are capable of sliding movement relative to one another when expandable sand control screen 280 is expanded. Alternatively, filter medium 288 could include one or more sections without filtration capability that are easily circumferentially expandable thereby allowing the filter medium to be more easily radially expanded.

Figure 14:
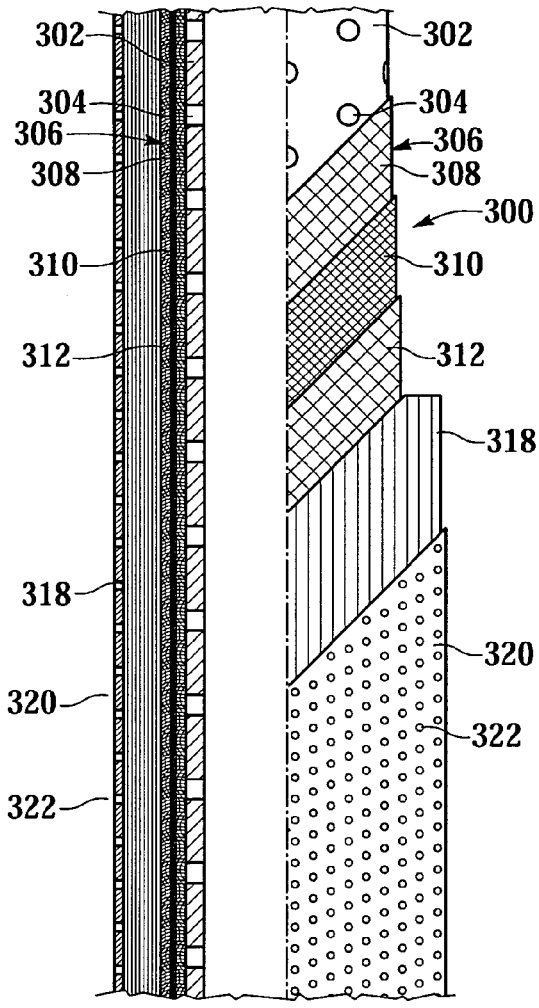
FIG. 14 is a quarter section view that is partially cut away of another embodiment of an expandable sand control screen having a crushable layer of the present invention.

Referring next to FIG. 14, an expandable sand control screen embodying principles of the present invention is representatively illustrated and generally designated 300. Expandable sand control screen 300 includes a generally tubular base pipe 302 that has a plurality of drainage openings 304 which allow the flow of production fluids into the production tubing. The exact number, size and shape of openings 304 are not critical to the present invention, so long as sufficient area is provided for fluid production, the integrity of base pipe 302 is maintained and base pipe 302 is suitably expandable.

Positioned around base pipe 302 is a filter medium 306. In the illustrated embodiment, filter medium 306 is a fluid-porous, particulate restricting, metal material such as a plurality of layers of a wire mesh that are diffusion bonded or sintered together to form a porous wire mesh screen designed to allow fluid flow therethrough but prevent the flow of particulate materials of a predetermined size from passing therethrough. More specifically, filter medium 306 includes three layers of filtering material, namely, an inner relatively coarse layer 308, a middle relatively fine layer 310 and an outer relatively coarse layer 312, as described above.

Positioned around outer layer 312 is a compliable member illustrated as fluid permeable crushable layer 318. Together, filter medium 306 and crushable layer 318 form the filtering assembly of expandable sand control screen 300. Crushable layer 318 preferably has a thickness of between about 0.25 inches and 2 inches and is preferably crushable to 80% of its original thickness, more preferably crushable to 50% of its original thickness and most preferably crushable to 20% of its original thickness, however, other thicknesses and crushability properties are possible and considered to be within the scope of the present invention. Preferably, the porosity of crushable layer 318, even in its crushed configuration, is greater than the porosity of the filter medium 306 such that crushable layer 318 will not significantly increase the pressure drop in the fluids produced therethrough. In addition, it should be appreciated that in embodiments having filter medium 306 positioned within crushable layer 318, outer layer 312 of filter medium 306 may not be required as crushable layer 318 may also serve as the outer drain layer.

As it is desirable to have a relatively smooth surface as the outmost component of expandable sand control screen 300, a generally tubular protective outer shroud 320 is positioned around crushable layer 318 in the illustrated embodiment. Outer shroud 320 has openings 322 formed through a sidewall thereof to admit fluid into expandable sand control screen 300. Outer shroud 320 protects crushable layer 318 from damage while expandable sand control screen 300 is being conveyed into its downhole position. Additionally, when expandable sand control screen 300 is expanded into compliant radial contact with a wellbore, outer shroud 320 provides radial support to prevent collapse of the wellbore. Even though FIG. 14 has depicted outer shroud 320 as being the outermost layer of expandable sand control screen 300, it should be clearly understood by those skilled in the art that a compliable member such as crushable layer 318 could alternatively serve as the outermost layer of expandable sand control screen 300 without the use of an outer shroud.

One benefit of the embodiment of expandable sand control screen 300 depicted in FIG. 14 is that crushable layer 318 is not required to support filter medium 306 during expansion. Crushable layer 318 is, nonetheless, preferably constructed of a durable, deformable, high strength material such as a metal including steels and stainless steels. In embodiments wherein outer shroud 320 is present, crushable layer 318 has the strength to provide the desired level of support to outer shroud 320 such that outer shroud 320 can be radially expanded. In embodiments with or without outer shroud 320, crushable layer 318 has the desired level of compliability such that when one or more portions of the outermost layer of expandable sand control screen 300 contact the wellbore, the thickness of the corresponding portions of crushable layer 318 are radially reducible such that expandable sand control screen 300 will comply with the irregular surface of the wellbore.

Figure 15:
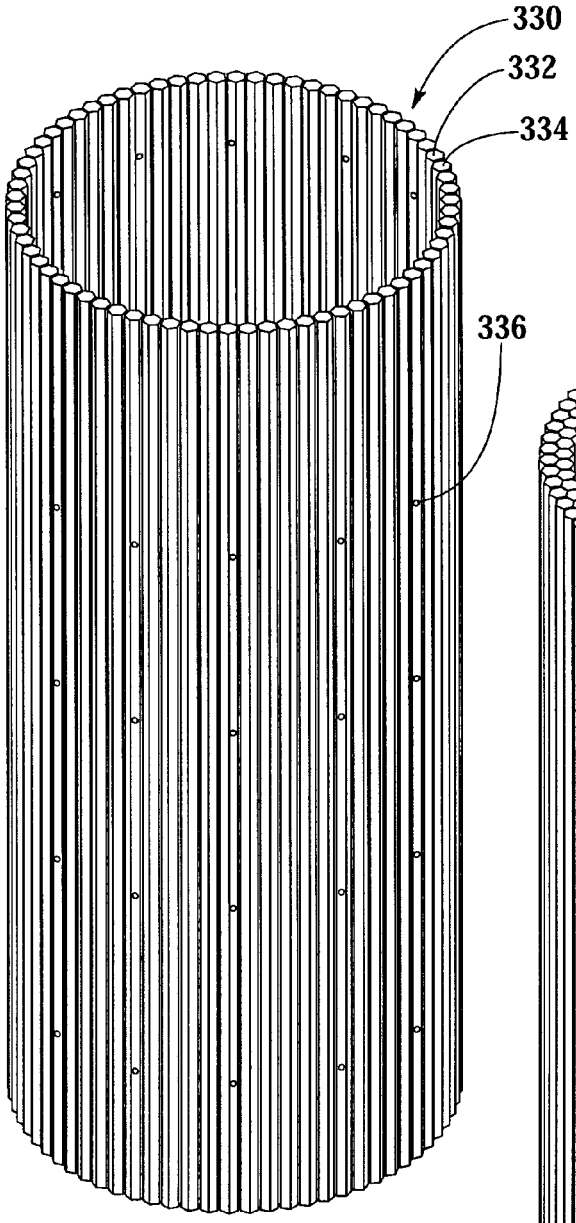
FIG. 15 is an isometric view of a crushable layer including a honeycomb structure for an expandable sand control screen of the present invention.

Referring next to FIG. 15, therein is depicted one embodiment of a crushable layer of the present invention that is generally designated 330. As illustrated, crushable layer 330 is a generally tubular member that has a honeycomb structure having a thickness that is radially reducible in response to a force created due to the expansion of an expandable sand control screen against a wellbore. More specifically, crushable layer 330 is a single layer honeycomb structure having side-by-side hexagonal cells, such as hexagonal cells 332, 334. It should be clearly understood, however, by those skilled in the art that the term "honeycomb structure" as used herein is not limited to structures having hexagonal cells but is intended to include structures having cells with other geometries. For example, other suitable geometries include, but are not limited to, circles, ovals, ellipses, diamonds, octagons and other polygons that provide the strength and deformation characteristics that are desirable for crushable layer 330. In addition, even thought FIG. 15 has depicted each of the cell within the honeycomb structure as having the same size and geometry, it should be understood by those skilled in the art that the cells within a given honeycomb structure could alternatively have a variety of sizes and geometries.

Crushable layer 330 is also permeable to the flow of formation fluids. In the illustrated embodiment, crushable layer 330 includes a plurality of openings 336 both on an exterior surface of the honeycomb structure and an interior surface of the honeycomb structure. The exact number, size and shape of openings 336 are not critical to the present invention, so long as sufficient area is provided for fluid production and the strength and deformation characteristics of crushable layer 330 are maintained. Preferably, the permeability of crushable layer 330 in its crushed configuration will be at least 30 percent greater than the permeability of the associated filter medium such that crushable layer 330 will not significantly increase the pressure drop in the fluids produced therethrough.

Figure 16:
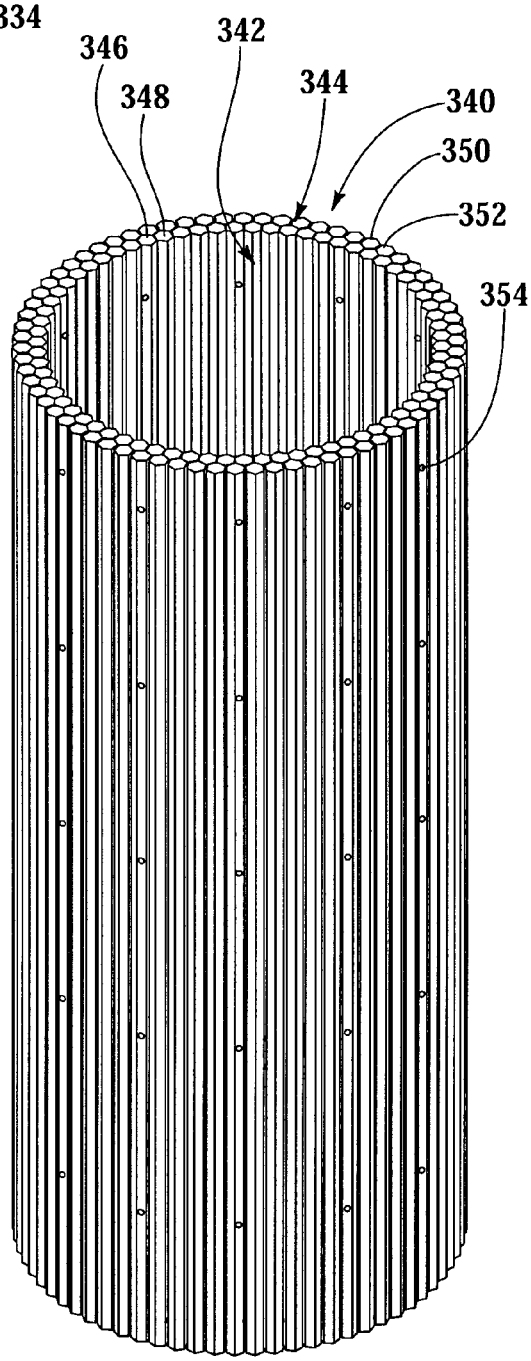
FIG. 16 is an isometric view of a crushable layer including a multi layer honeycomb structure for an expandable sand control screen of the present invention.

As should be apparent to those skilled in the art, the number of cells in the honeycomb structure will be dependent upon the diameter of crushable layer 330 as well as the size and shape of the cells in the honeycomb structure. The thickness of crushable layer 330, which will determine, in large part, the amount of deviation in the diameter of the wellbore that the present invention can overcome, will likewise be dependent upon the size and shape of the cells in the honeycomb structure. In addition, the thickness of crushable layer 330 will be dependent upon the organization of cells in the honeycomb structure. For example, as best seen in FIG. 16, crushable layer 340 is a tubular member having a multi layer honeycomb structure including inner honeycomb layer 342 and outer honeycomb layer 344. Each layer 342, 344 is formed from side-by-side hexagonal cells, such as hexagonal cells 346, 348 and hexagonal cells 350, 352, respectively. As stated above, even though hexagonal cells, which form a close fitting relationship between layers 342, 344, have been depicted, cells having other geometries may be used in keeping with the principles of the present invention.

Additionally, even though FIG. 16 has depicted crushable layer 340 as having two honeycomb layers 342, 344, it should be understood by those skilled in the art that a crushable layer having more than two honeycomb layers is possible and is considered within the scope of the present invention as the desired thickness of crushable layer 340 as well as the size of the cells in the honeycomb layers will determine the required number of layers. Furthermore, even though FIG. 16 has depicted each of the two honeycomb layers 342, 344 of crushable layer 340 with cells having the same geometry, it should be understood by those skilled in the art that a crushable layer having different sized or different shaped cells in the different honeycomb layers is possible and is considered within the scope of the present invention.

Crushable layer 340 is permeable to the flow of formation fluids. In the illustrated embodiment, crushable layer 340 includes a plurality of openings 354 that traverse both honeycomb layers 342, 344. The exact number, size and shape of openings 354 are not critical to the present invention, so long as sufficient area is provided for fluid production and the strength and deformation characteristics of crushable layer 340 are maintained.

Figure 17:
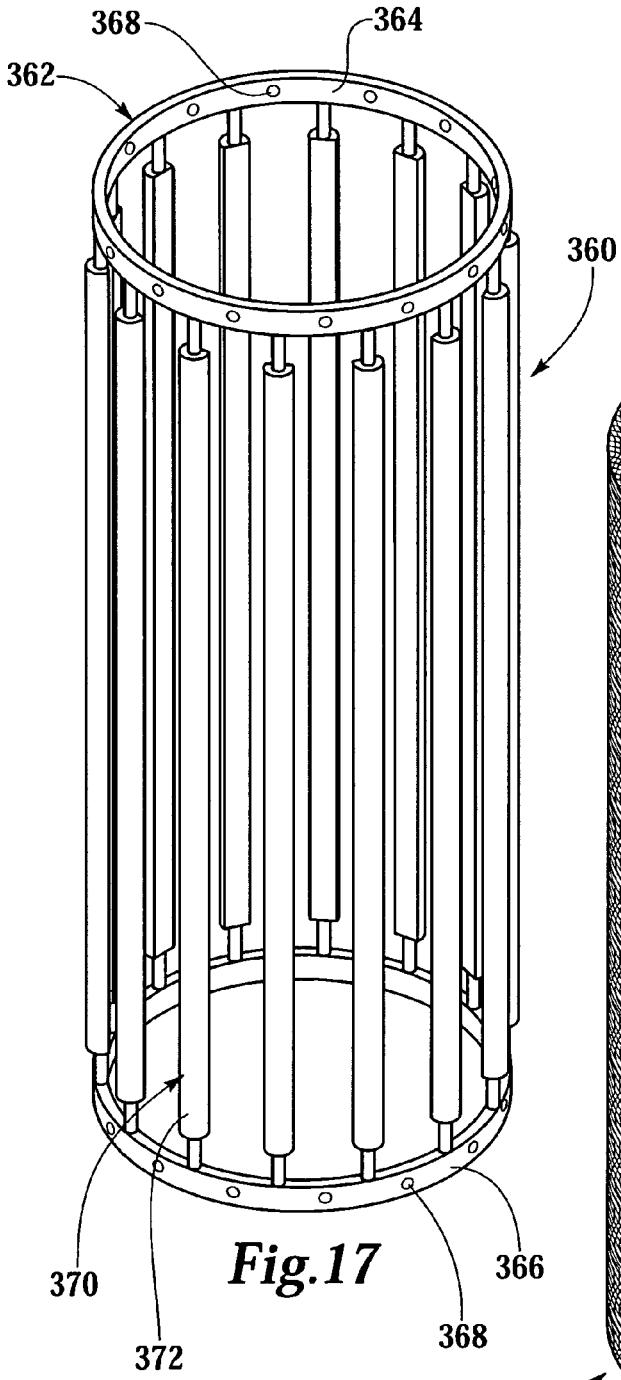
FIG. 17 is an isometric view of a crushable layer including a plurality of crushable elements for an expandable sand control screen of the present invention.

Referring next to FIG. 17, therein is depicted a crushable layer of the present invention that is generally designated 360. As illustrated, crushable layer 360 includes a support structure 362 having ring members 364, 366. In the illustrated embodiment, each ring member 364, 366 includes a plurality of apertures 368 that are designed to reduce the force necessary to radially expand support structure 362. Alternatively or additionally, ring members 364, 366 may have thin wall sections or other suitable configuration that are designed to reduce the force necessary to radially expand support structure 362. Extending between ring members 364, 166 are crushable elements 370. Crushable elements 370 include semi-cylindrical portions 372 that are radially deformable in response to a force created due to the expansion of an expandable sand control screen against a wellbore.

The following example will describe the operation of crushable layer 360 when crushable layer 360 is positioned between a base pipe and a filter medium of an expandable sand control screen such as crushable layer 286 of FIG. 13. Preferably, crushable layer 360 is positioned on the base pipe such that the drainage openings of the base pipe are between adjacent crushable elements 370 to maintain fluid permeability therethrough. During expansion, as the base pipe is radially enlarged, ring members 364, 366 circumferentially extend which allows support structure 362 to radially expand. The radial expansion of support structure 362 causes crushable elements 370 to place a radially outward force on the filter medium which radially expands the filter medium without radially reducing the thickness of crushable elements 370. When a portion of the filter medium contacts the surface of the wellbore, the force created between the expanding base pipe and the wellbore on a portion of a corresponding crushable element 370 will cause the thickness of that portion of the corresponding crushable element 370 to be radially reduced. This radial reduction process allows the expandable sand control screen including crushable layer 360 to comply with the irregularities of the wellbore profile.

Even though FIG. 17 has depicted crushable layer 360 as having axially oriented crushable elements 370, it should be understood by those skilled in the art that crushable elements having different orientation including, but not limited to, circumferentially oriented crushable elements, helically oriented crushable elements and the like could alternatively be used without departing from the principles of the present invention. Likewise, even though FIG. 17 has depicted crushable layer 360 as having crushable elements 370 with semi-cylindrical portions 372, it should be understood by those skilled in the art that crushable layer 360 could have alternately shaped crushable elements without departing from the principles of the present invention.

Figure 18:
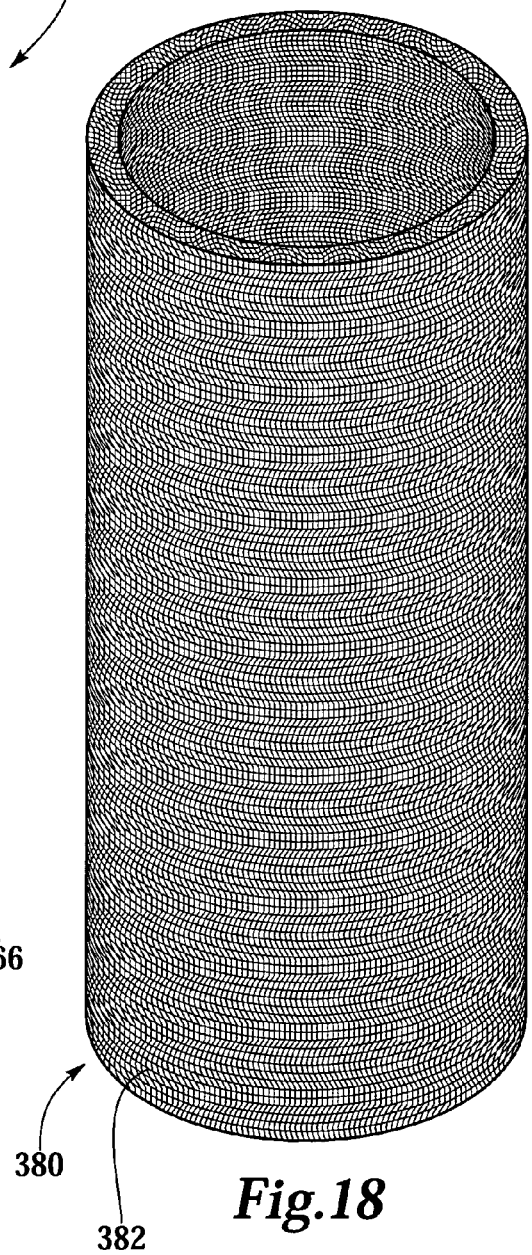
FIG. 18 is an isometric view of a crushable layer including a mesh structure for an expandable sand control screen of the present invention.

Referring next to FIG. 18, therein is depicted a fluid permeable crushable layer of the present invention that is generally designated 380. As illustrated, crushable layer 380 includes a generally tubular mesh structure 382 that is radially deformable in response to a force created due to the expansion of an expandable sand control screen against a wellbore. Preferably, mesh structure 382 consists of wires of various metals such as steels, stainless steels, Inconels, Hastaloy and the like that have been knitted together into a matrix of interlocking loops that allows two dimensional movement in the mesh plane. Mesh structure 382 has sufficient strength under compression to expand a filter medium positioned exteriorly thereof but also yields under sufficient compressive force to allow the expandable sand control screen to conform to the surface of the wellbore.

In addition, mesh structure 382 has resiliency under compression such that mesh structure 382 exerts a radially outward force which enhances the ability of the expandable sand control screen to support the wellbore. Also, in those embodiments in which crushable layer 380 is disposed exteriorly of the filter medium, mesh structure 382 has the added advantage of serving as a pre-filter for the formation fluids traveling therethrough. Even though fluid permeable crushable layer 380 of FIG. 18 has been described as a mesh structure having particular characteristics, it should be understood by those skilled in the art that fluid permeable crushable layer 380 could alternatively be constructed from other crushable materials including open cell foams made from resins, polyolefins, polyurethanes, polyvinylchlorides, metals, ceramics or the like as well as fiberglass wools, steel wools, stainless steel wools and the like.

Figure 19:
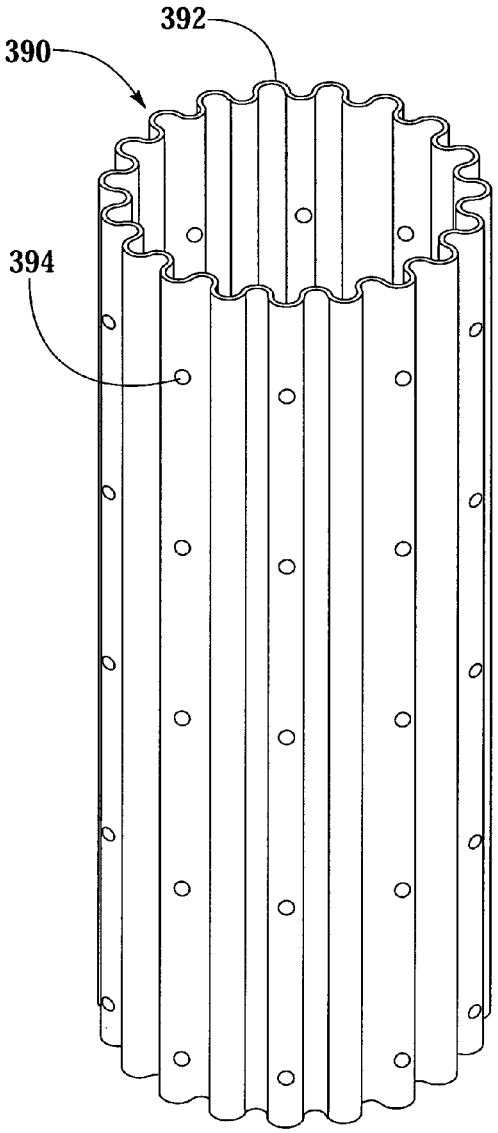
FIG. 19 is an isometric view of a crushable layer including a corrugated structure for an expandable sand control screen of the present invention.

Referring next to FIG. 19, therein is depicted a crushable layer of the present invention that is generally designated 390. As illustrated, crushable layer 390 includes a corrugated structure 392 that is radially deformable in response to a force created due to the expansion of an expandable sand control screen against a wellbore. Preferably, corrugated structure 392 consists of a metal such as steels, stainless steels or the like that is formed into a generally tubular structure having alternating grooves and ridges. Crushable layer 390 is permeable to the flow of formation fluids. In the illustrated embodiment, crushable layer 390 includes a plurality of openings 394. The exact number, size and shape of openings 394 are not critical to the present invention, so long as sufficient area is provided for fluid production and the strength and deformation characteristics of crushable layer 390 are maintained.

In the illustrated embodiment, crushable layer 390 is depicted as having an axially oriented corrugated structure 392. As should be understood by those skilled in the art, as an expandable sand control screen including crushable layer 390 is expanded, the thickness of corrugated structure 392 will be reduced. Accordingly, the thickness of corrugated structure 392 is sufficient to not only allow for expansion, but also, provide for compliability during expansion. Also, it should be noted by those skilled in the art that a crushable layer having a corrugated structure with a different orientation including, but not limited to, a circumferentially oriented corrugated structure, a helically oriented corrugated structure and the like could alternatively be used without departing from the principles of the present invention. In addition, those skilled in the art will recognize that a multi layer corrugated structure could alternatively be used as the crushable layer of the present invention. In such a multi layer corrugated structure, the orientation of the corrugated layers within the corrugated structure could vary, for example, one of the corrugated layers could have axially oriented corrugations while another of the corrugated layers could have circumferentially oriented corrugations.

Figure 20:
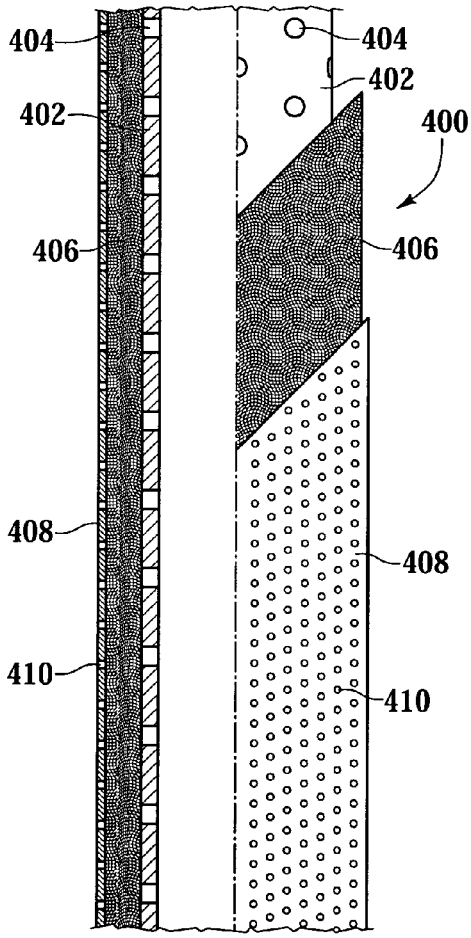
FIG. 20 is a quarter section view that is partially cut away of an expandable sand control screen having a crushable filter medium of the present invention.

Referring additionally now to FIG. 20, an expandable sand control screen embodying principles of the present invention is representatively illustrated and generally designated 400. Expandable sand control screen 400 includes a generally tubular base pipe 402 that includes a plurality of drainage openings 404 which allow the flow of production fluids into the production tubing. The exact number, size and shape of openings 404 are not critical to the present invention, so long as sufficient area is provided for fluid production, the integrity of base pipe 402 is maintained and base pipe 402 is suitably expandable.

Positioned around base pipe 402 is a crushable filter medium 406 that serves as the entire filtering assembly for expandable sand control screen 400. Crushable filter medium 406 preferably has a thickness of between about 0.25 inches and 2 inches and is preferably crushable to 80% of its original thickness, more preferably crushable to 50% of its original thickness and most preferably crushable to 20% of its original thickness. It should be apparent to those skilled in the art, however, that the thickness and crushability of crushable filter medium 406 will be dependent upon a variety of factors such as the clearance within the wellbore, the size of expandable sand control screen 400, the structural composition of crushable filter medium 406, the desired amount of expansion of expandable sand control screen 400, the expected deviation in the wellbore diameter and the like.

In the illustrated embodiment, each surface of crushable filter medium 406 is a fluid-porous, particulate restricting, metal material such as a plurality of layers of a wire mesh that are diffusion bonded or sintered together to form a porous wire mesh screen designed to allow fluid flow therethrough but prevent the flow of particulate materials of a predetermined size from passing therethrough, as explained in greater detail below.

In the illustrated embodiment, positioned around crushable filter medium 406 is a generally tubular protective outer shroud 408 that forms the outermost layer of crushable filter medium 406 as well as the outer layer of expandable sand control screen 400. Outer shroud 408 has openings 410 formed through a sidewall thereof to admit fluid into expandable sand control screen 400. Outer shroud 408 protects crushable filter medium 406 from damage while expandable sand control screen 400 is being conveyed and positioned in a well. Additionally, when expandable sand control screen 400 is expanded into radial contact with a wellbore, outer shroud 408 protects crushable filter medium 406 from damage due to such direct contact and provides radial support to prevent collapse of the wellbore. Thus, outer shroud 408 is preferably constructed of a durable, deformable, high strength material, such as steel, although other materials may be used in keeping with the principles of the present invention. It should be noted by those skilled in the art that outer shroud 408 could optionally be omitted from around crushable filter medium 406 in which case crushable filter medium 406 would compliantly contact the wellbore when expandable sand control screen 400 is expanded.

In operation, when expandable sand control screen 400 is expanded, crushable filter medium 406 has the desired level of deformability such that when one or more portions of expandable sand control screen 400 contact the wellbore, the thickness of the corresponding portion of crushable filter medium 406 is radially reducible such that expandable sand control screen 400 will comply with the irregular surface of the wellbore profile. Thereafter, crushable filter medium 406 serves to prevent the production of formation fines therethrough.

Figure 21:
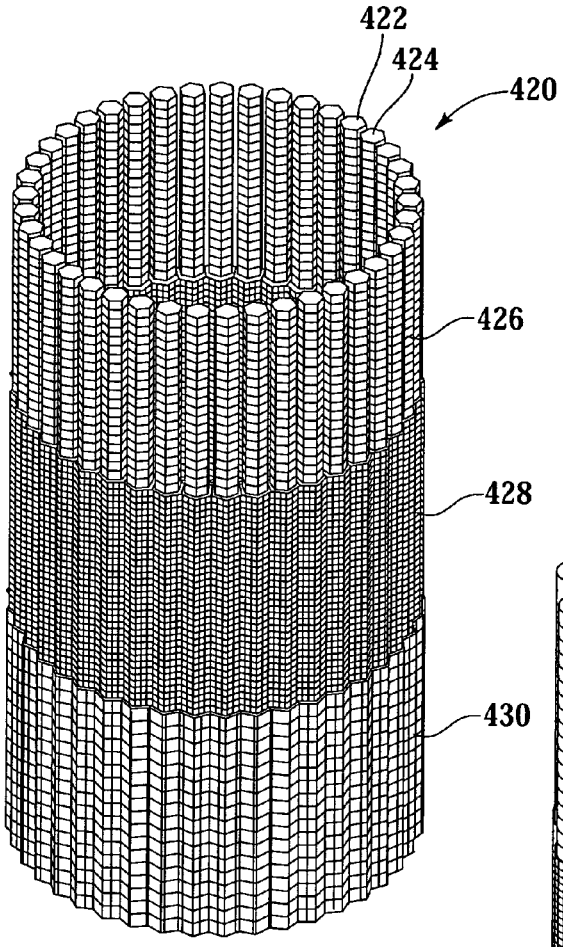
FIG. 21 is an isometric view of a crushable filter medium having a honeycomb structure for an expandable sand control screen of the present invention.

Referring next to FIG. 21, therein is depicted one embodiment of a crushable filter medium of the present invention that is generally designated 420. As illustrated, crushable filter medium 420 is a fluid porous, particulate restricting, generally tubular member having a honeycomb structure with a thickness that is radially reducible in response to a force created due to the expansion of an expandable sand control screen against a wellbore. More specifically, crushable filter medium 420 is a single layer honeycomb structure having side-by-side hexagonal cells, such as hexagonal cells 422, 424. In the illustrated embodiment, the outer walls of each cell are constructed from three layers of filtering material, namely, an inner relatively coarse layer 426, a middle relatively fine layer 428 and an outer relatively coarse layer 430, similar to the filter media described above.

Even though FIG. 21 has depicted a honeycomb structure having hexagonal cells, it should be understood by those skilled in the art that cells with other geometries including, but not limited to, circles, ovals, ellipses, diamonds, octagons and other polygons could alternatively be used for crushable filter medium 420. In addition, even though FIG. 21 has depicted each of the cells within the honeycomb structure as having the same size and geometry, it should be understood by those skilled in the art that the cells within a given honeycomb structure could alternatively have a variety of sizes and geometries. Further, even though FIG. 21 has depicted a three layer filtration media for crushable filter medium 420, it should be understood by those skilled in the art that other types of filter media having other numbers of layers or other configurations could alternatively be used.

The thickness of crushable filter medium 420, which will determine, in large part, the amount of deviation in the diameter of the wellbore that the present invention can overcome, will be dependent upon the size and shape of the cells in the honeycomb structure and whether the honeycomb structure is a single or a multi layer honeycomb structure. In embodiment having a multi layer honeycomb structure, it should be understood by those skilled in the art that cells in the different honeycomb layers may have different sizes or geometries without departing from the principles of the present invention.

Figure 22:
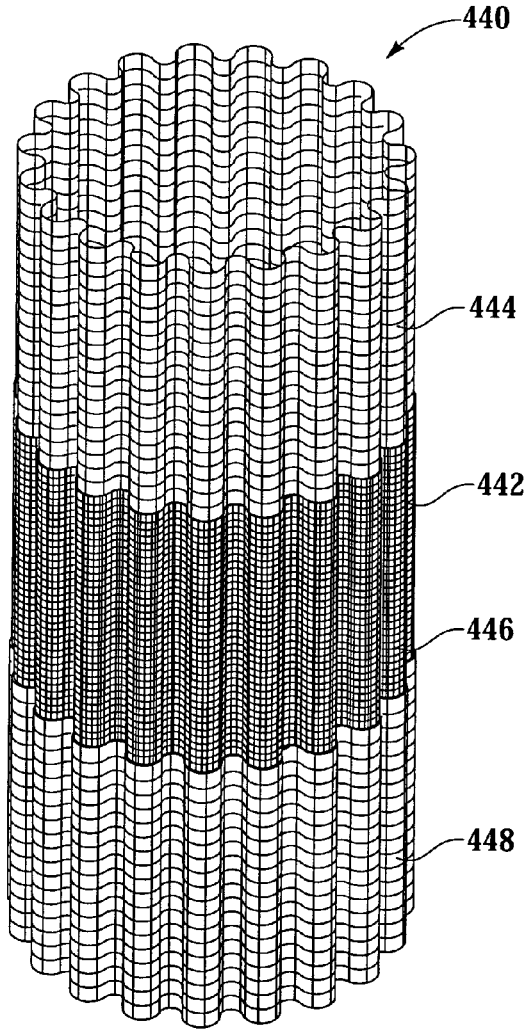
FIG. 22 is an isometric view of a crushable filter medium having a corrugated structure for an expandable sand control screen of the present invention.

Referring next to FIG. 22, therein is depicted a crushable filter medium of the present invention that is generally designated 440. As illustrated, crushable filter medium 440 includes a corrugated structure 442 that is radially deformable in response to a force created due to the expansion of an expandable sand control screen against a wellbore and is capable of filtering particulate out of production fluids. Preferably, corrugated structure 442 consists a fluid-porous, particulate restricting, metal material such as a plurality of layers of a wire mesh that are diffusion bonded or sintered together to form a porous wire mesh screen designed to allow fluid flow therethrough but prevent the flow of particulate materials of a predetermined size from passing therethrough such as the three layer filter medium described above having an inner relatively coarse layer 444, a middle relatively fine layer 446 and an outer relatively coarse layer 448.

In the illustrated embodiment, crushable filter medium 440 is depicted as being a single layer axially oriented corrugated structure 442, it should be noted, however, by those skilled in the art that a crushable filter medium having a corrugated structure having multiple layers and/or with a different orientation including, but not limited to, a circumferentially oriented corrugated structure, a helically oriented corrugated structure and the like could alternatively be used without departing from the principles of the present invention. Also, as should be understood by those skilled in the art, as an expandable sand control screen including crushable filter medium 430 is expanded, the thickness of corrugated structure 442 will be reduced. Accordingly, the thickness of corrugated structure 442 is sufficient to not only allow for expansion, but also, provide for crushability during expansion.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An expandable sand control screen that is positionable within a wellbore comprising:

a generally tubular member that is expanded downhole, the generally tubular member having drainage openings that allow the flow of production fluids therethrough; and a filtering assembly disposed exteriorly of the generally tubular member, the filtering assembly including a filter medium that prevents the flow of particulate material of a predetermined size therethrough but allowing the flow of production fluids therethrough and a compressible filler material disposed exteriorly of the filter medium that resiliently recovers downhole toward the wellbore in void regions.

2. The expandable sand control screen as recited in claim 1 wherein the filter medium further comprises a plurality of layers of wire mesh that are bonded together to form a porous wire mesh screen.

3. The expandable sand control screen as recited in claim 1 wherein the filter medium further comprises a protective outer shroud.

4. The expandable sand control screen as recited in claim 1 wherein the compressible filler material further comprises an open cell foam.

5. The expandable sand control screen as recited in claim 4 wherein the open cell foam is selected from a group consisting of resins, polyolefins, polyurethanes, polyvinylchlorides, metals and ceramics.

6. The expandable sand control screen as recited in claim 1 wherein the compressible filler material further comprises material selected from the group consisting of fiberglass wools and steel wools.

7. The expandable sand control screen as recited in claim 1 wherein the compressible filler material further comprises at least one permeable section and at least one impermeable section.

8. The expandable sand control screen as recited in claim 1 further comprising a removable outer wrapper disposed exteriorly of the compressible filler material to temporarily maintain the compressible filler material in a compressed position.

9. The expandable sand control screen as recited in claim 8 wherein the removable outer wrapper is shrinkable to place the compressible filler material in a compressed configuration.

10. The expandable sand control screen as recited in claim 8 wherein the removable outer wrapper is selected from the group consisting of mechanically removable outer wrappers, chemically removable outer wrappers, thermally removable outer wrappers, dissolvably removable outer wrappers and biodegradably removable outer wrappers.

11. The expandable sand control screen as recited in claim 8 wherein the removable outer wrapper further comprises a film.

12. The expandable sand control screen as recited in claim 8 wherein the removable outer wrapper further comprises a strap.

13. The expandable sand control screen as recited in claim 8 wherein the removable outer wrapper is selected from a group consisting of polymers, metals and ceramics.

14. The expandable sand control screen as recited in claim 1 further comprising a treatment chemical impregnated into the compressible filler material.

15. The expandable sand control screen as recited in claim 14 wherein the treatment chemical is selected from a group consisting of powders, tablets and beads.

16. The expandable sand control screen as recited in claim 14 wherein the treatment chemical is selected from a group consisting of mud breakers, oxidizers, enzymes, hydrolyzable esters, acids, scale inhibitors, biocides, corrosion inhibitors and paraffin inhibitors.

17. The expandable sand control screen as recited in claim 14 further comprising solid materials impregnated into the compressible filler material that are selected from a group consisting of sand, gravel, proppants and beads.

18. An expandable sand control screen that is positionable within a wellbore comprising:

a generally tubular member that is expanded downhole having drainage openings that allow the flow of production fluids therethrough; and a filter medium disposed exteriorly of the tubular member that prevents the flow of particulate material of a predetermined size therethrough but allows the flow of production fluids therethrough; and a compressible filler material disposed exteriorly of the filter medium that resiliently recovers downhole toward the wellbore in void regions and allows the flow of production fluids therethrough.

19. The expandable sand control screen as recited in claim 18 wherein the filter medium further comprises a protective outer shroud.

20. The expandable sand control screen as recited in claim 18 wherein the compressible filler material is selected from the group consisting of open cell foams, steel wools and fiberglass wools.

21. The expandable sand control screen as recited in claim 20 wherein the open cell foam is selected from a group consisting of resins, polyolefins, polyurethanes, polyvinylchlorides, metals and ceramics.

22. The expandable sand control screen as recited in claim 18 wherein the compressible filler material further comprises at least one permeable section and at least one impermeable section.

23. The expandable sand control screen as recited in claim 18 further comprising a removable outer wrapper disposed exteriorly of the compressible filler material to temporarily maintain the compressible filler material in a compressed position.

24. The expandable sand control screen as recited in claim 23 wherein the removable outer wrapper is shrinkable to place the compressible filler material in the compressed position.

25. The expandable sand control screen as recited in claim 23 wherein the removable outer wrapper is selected from the group consisting of mechanically removable outer wrappers, chemically removable outer wrappers, thermally removable outer wrappers, dissolvably removable outer wrappers and biodegradably removable outer wrappers.

26. The expandable sand control screen as recited in claim 23 wherein the removable outer wrapper is selected from the group consisting of films and straps.

27. The expandable sand control screen as recited in claim 23 wherein the removable outer wrapper is selected from a group consisting of polymers, metals and ceramics.

28. The expandable sand control screen as recited in claim 23 further comprising a treatment chemical impregnated into the compressible filler material.

29. The expandable sand control screen as recited in claim 28 wherein the treatment chemical is selected from a group consisting of powders, tablets and beads.

30. The expandable sand control screen as recited in claim 28 wherein the treatment chemical is selected from a group consisting of mud breakers, oxidizers, enzymes, hydrolyzable esters, acids, scale inhibitors, biocides, corrosion inhibitors and paraffin inhibitors.

31. The expandable sand control screen as recited in claim 18 further comprising solid materials impregnated into the compressible filler material.

32. The expandable sand control screen as recited in claim 31 wherein the solid materials are selected from a group consisting of sand, gravel, proppants and beads.

* * * * *